US011125113B2

(12) United States Patent
Nishioka et al.

(10) Patent No.: US 11,125,113 B2
(45) Date of Patent: Sep. 21, 2021

(54) GAS TURBINE EXHAUST CASING AND GAS TURBINE

(71) Applicant: Mitsubishi Hitachi Power Systems, Ltd., Kanagawa (JP)

(72) Inventors: Yasunori Nishioka, Yokohama (JP); Shinya Hashimoto, Yokohama (JP); Takuro Kameda, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 104 days.

(21) Appl. No.: 16/717,157

(22) Filed: Dec. 17, 2019

(65) Prior Publication Data

US 2020/0200044 A1 Jun. 25, 2020

(30) Foreign Application Priority Data

Dec. 25, 2018 (JP) ..... JP2018-240735

(51) Int. Cl.
*F01D 25/24* (2006.01)
*F01D 25/16* (2006.01)

(52) U.S. Cl.
CPC ..... *F01D 25/243* (2013.01); *F05D 2240/14* (2013.01)

(58) Field of Classification Search
CPC ..... F01D 25/243; F01D 25/162; F01D 25/30; F01D 25/24; F01D 25/246; F01D 25/26; F01D 25/28; F01D 25/14; F01D 9/065; F05D 2230/642; F05D 2240/14; F05D 2260/30; F05B 2230/606
See application file for complete search history.

(56) References Cited

U.S. PATENT DOCUMENTS

| | | | | |
|---|---|---|---|---|
| 7,198,465 | B1 | 4/2007 | Ichiryu | |
| 8,616,835 | B2 * | 12/2013 | Hashimoto | F02C 7/18 415/142 |
| 9,644,494 | B2 * | 5/2017 | Hashimoto | F01D 25/12 |
| 2013/0064647 | A1 | 3/2013 | Hashimoto | |
| 2015/0040393 | A1 * | 2/2015 | Shteyman | F01D 25/30 29/888.02 |
| 2015/0098811 | A1 * | 4/2015 | Roth | F01D 25/28 415/207 |

FOREIGN PATENT DOCUMENTS

| | | |
|---|---|---|
| JP | 2001-107922 | 4/2001 |
| JP | 4182098 | 11/2008 |
| JP | 2013-57302 | 3/2013 |

* cited by examiner

*Primary Examiner* — J. Todd Newton
*Assistant Examiner* — Eric J Zamora Alvarez
(74) *Attorney, Agent, or Firm* — Wenderoth, Lind & Ponack, L.L.P.

(57) ABSTRACT

A gas turbine exhaust casing includes a tubular casing wall, a bearing box housed in the casing wall, a diffuser portion forming an annular exhaust gas flow passage between the casing wall and the bearing box, a plurality of struts disposed at intervals in a circumferential direction of the casing wall, and coupling the casing wall and the bearing box, and a plurality of fastening bolts disposed on the casing wall. The casing wall includes an upper half casing forming an upper half of the casing wall and a lower half casing forming a lower half of the casing wall. The plurality of fastening bolts fasten the upper half casing and the lower half casing. The plurality of struts include a penetrated strut which has an end penetrated by at least one fastening bolt of the plurality of fastening bolts.

6 Claims, 7 Drawing Sheets

GAS TURBINE EXHAUST CASING AND GAS TURBINE

TECHNICAL FIELD

The present disclosure relates to a gas turbine exhaust casing and a gas turbine.

BACKGROUND

A gas turbine exhaust casing described in Patent Document 1 includes a tubular casing wall, a bearing box housed in the casing wall, a diffuser portion forming an annular exhaust gas flow passage between the casing wall and the bearing box, and a plurality of struts disposed at intervals in the circumferential direction of the casing wall and coupling the casing wall and the bearing box.

CITATION LIST

Patent Literature

Patent Document 1: JP2013-57302A

SUMMARY

In recent years, in order to increase an output of and to improve performance of a gas turbine, it is required to upsize an exhaust gas flow passage of an exhaust casing. On the other hand, the outer diameter of the exhaust casing is also likely to expand if the exhaust gas flow passage is upsized, which may place a constraint on, for example, the transport of the exhaust casing.

In view of the above, an object of at least one embodiment of the present invention is to provide a gas turbine exhaust casing and a gas turbine including the same. The gas turbine exhaust casing can suppress the expansion of an external dimension in the horizontal direction orthogonal to the axial center of a turbine rotor while upsizing the exhaust gas flow passage.

(1) A gas turbine exhaust casing according to at least one embodiment of the present invention includes a tubular casing wall, a bearing box housed in the casing wall, a plurality of struts disposed at intervals in a circumferential direction of the casing wall, and coupling the casing wall and the bearing box, and a plurality of fastening bolts disposed on the casing wall. The casing wall includes an upper half casing forming an upper half of the casing wall and a lower half casing forming a lower half of the casing wall. The plurality of fastening bolts fasten the upper half casing and the lower half casing. The plurality of struts include a penetrated strut which has an end penetrated by at least one fastening bolt of the plurality of fastening bolts.

With the gas turbine exhaust casing according to the above configuration (1), since the fastening bolt fastens the upper half casing and the lower half casing so as to penetrate the end of the penetrated strut, it is possible to reduce a distance between the fastening bolt and an axial center of a turbine rotor of a gas turbine as compared with a case in which the upper half casing and the lower half casing are fastened with the fastening bolt while avoiding the end of the strut. Thus, it is easy to reduce a distance between the axial center of the turbine rotor and an outer surface of the casing wall which is formed along the fastening bolt penetrating the end of the penetrated strut. Therefore, it is possible to suppress the expansion of an external dimension, of the external dimension of the gas turbine exhaust casing, in the horizontal direction orthogonal to the axial center of the turbine rotor while upsizing the exhaust gas flow passage.

Moreover, since it is possible to reduce the distance between the fastening bolt and the axial center of the turbine rotor, it is possible to suppress an increase in moment acting on the fastening bolt when the tubular casing wall expands due to heat transmission from a high-temperature exhaust gas. Therefore, it is possible to suppress a breakage in the fastening bolt and to implement a stable operation of the gas turbine.

(2) In some embodiments, in the gas turbine exhaust casing according to the above configuration (1), the end of the penetrated strut and the casing wall are connected via a welding portion, and the at least one fastening bolt penetrates the end and the welding portion. It is also possible to suppress the breakage in the fastening bolt and to implement the stable operation of the gas turbine.

With the gas turbine exhaust casing according to the above configuration (2), it is possible to suppress the expansion of the external dimension, of the external dimension of the gas turbine exhaust casing, in the horizontal direction orthogonal to the axial center of the turbine rotor while upsizing the exhaust gas flow passage.

(3) In some embodiments, in the gas turbine exhaust casing according to the above configuration (1) or (2), the penetrated strut has an end surface on a side of the casing wall, the end surface being formed so as not to protrude from an outer surface of the casing wall.

With the gas turbine exhaust casing according to the above configuration (3), since it is possible to eliminate an influence of the dimension of the penetrated strut on the external dimension in the horizontal direction orthogonal to the axial center of the turbine rotor, it is possible to suppress the expansion of the external dimension in the above-described horizontal direction while upsizing the exhaust gas flow passage.

(4) In some embodiments, in the gas turbine exhaust casing according to any one of the above configurations (1) to (3), the plurality of struts include an adjacent strut adjacent to the penetrated strut across a boundary between the upper half casing and the lower half casing, and $\theta_2>0.5\theta_1$ is satisfied, where, regarding angles around an axial center of the casing wall, $\theta_1$ is an angle between the end of the penetrated strut and an end of the adjacent strut, and $\theta_2$ is an angle between an upper end of the at least one fastening bolt penetrating the penetrated strut and a lower end of the at least one fastening bolt.

As the distance between the fastening bolt and the axial center of the turbine rotor decreases, a bolt length required of the fastening bolt in order to fasten the upper half casing and the lower half casing increases. In this regard, in the gas turbine exhaust casing according to the above configuration (4), since $\theta_2>0.5\theta_1$ is satisfied, the fastening bolt has a significantly long length with respect to a circumferential distance between the ends of the adjacent struts. Thus, it is possible to fasten the upper half casing and the lower half casing by using the significantly long fastening bolt which can reduce the distance with the axial center of the turbine rotor while penetrating the end of the penetrated strut. Therefore, it is easy to reduce the distance between the axial center of the turbine rotor and the outer surface of the casing wall which is formed along the fastening bolt penetrating the end of the penetrated strut. Therefore, it is possible to suppress the expansion of the external dimension, of the external dimension of the gas turbine exhaust casing, in the horizontal direction orthogonal to the axial center of the turbine rotor while upsizing the exhaust gas flow passage.

(5) In some embodiments, in the gas turbine exhaust casing according to any one of the above configurations (1) to (4), an outer surface of the upper half casing includes a first planar portion formed along a vertical plane, an outer surface of the lower half casing includes a second planar portion which is adjacent to the first planar portion and is formed along the vertical plane, and $L_1>L_2$ is satisfied, where $L_1$ is a vertical dimension from an upper end of the first planar portion to a lower end of the second planar portion, and $L_2$ is an axial dimension of the first planar portion.

As the distance between the fastening bolt and the axial center of the turbine rotor decreases, the bolt length required of the fastening bolt in order to fasten the upper half casing and the lower half casing increases. In this regard, with the gas turbine exhaust casing according to the above configuration (5), since $L_1>L_2$ is satisfied, it is possible to form the first planar portion and the second planar portion along the significantly long fastening bolt which can reduce the distance with the axial center of the turbine rotor while penetrating the end of the penetrated strut. Thus, it is easy to reduce a distance between the axial center of the turbine rotor and the first planar portion (and the second planar portion) formed along the fastening bolt penetrating the end of the penetrated strut. Therefore, it is possible to suppress the expansion of the external dimension, of the external dimension of the gas turbine exhaust casing, in the horizontal direction orthogonal to the axial center of the turbine rotor while upsizing the exhaust gas flow passage.

(6) A gas turbine according to at least one embodiment of the present invention includes a compressor, a combustor for combusting compressed air generated by the compressor in mixture with fuel, a turbine for obtaining power from a combustion gas generated by the combustor, and the gas turbine exhaust casing according to any one of the above configurations (1) to (5), the gas turbine exhaust casing being configured to allow passage of an exhaust gas of the turbine.

With the gas turbine according to the above configuration (6), since the gas turbine includes the gas turbine exhaust casing according to the above configurations (1) to (5), it is possible to suppress the expansion of the external dimension, of the external dimension of the gas turbine exhaust casing, in the horizontal direction orthogonal to the axial center of the turbine rotor while upsizing the exhaust gas flow passage. It is also possible to suppress the breakage in the fastening bolt and to implement the stable operation of the gas turbine.

According to at least one embodiment of the present invention, a gas turbine exhaust casing and a gas turbine including the same are provided. The gas turbine exhaust casing can suppress the expansion of an external dimension in the horizontal direction orthogonal to the axial center of a turbine rotor while upsizing an exhaust gas flow passage.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
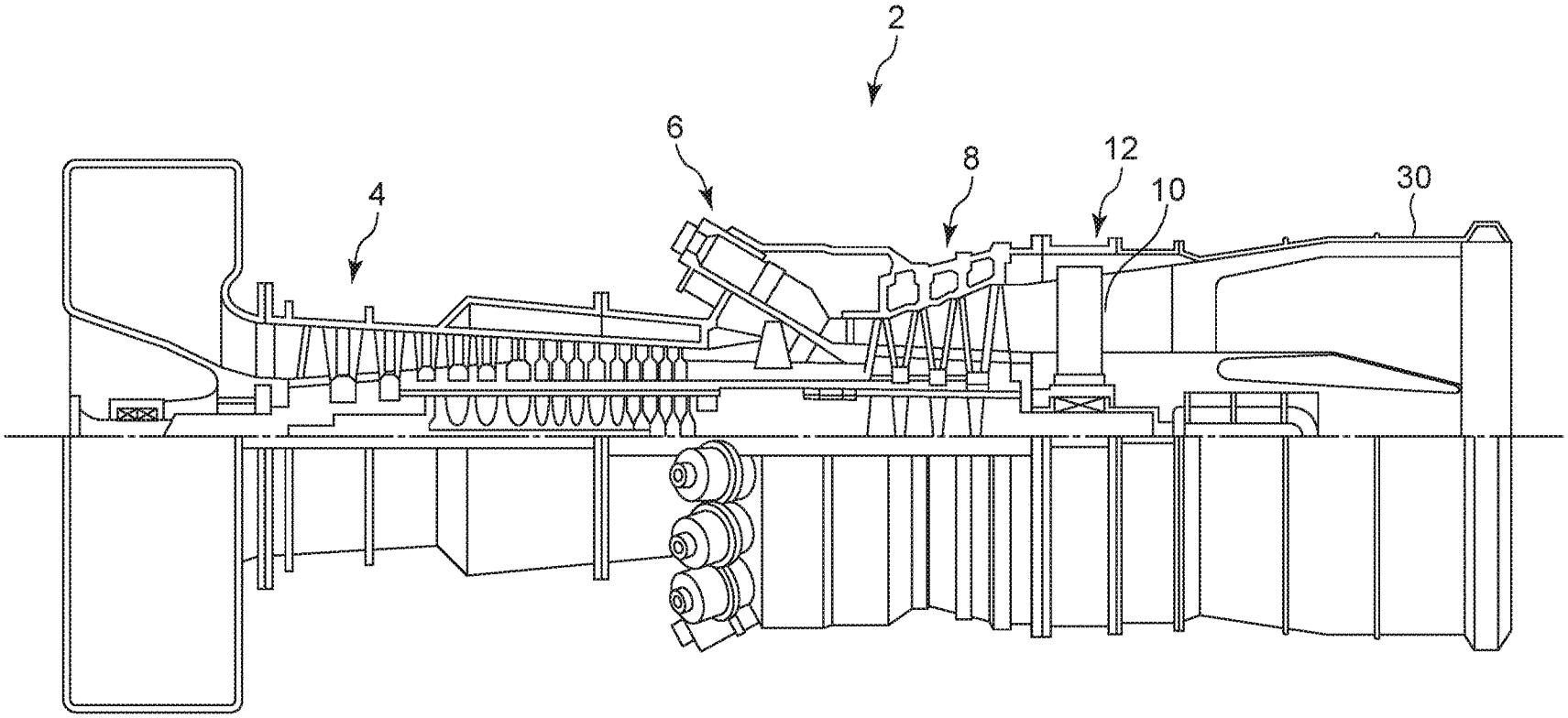
FIG. 1 is a view showing the schematic configuration of a gas turbine 2 according to an embodiment.

FIG. 1 is a view showing the schematic configuration of a gas turbine 2 according to an embodiment.

As shown in FIG. 1, the gas turbine 2 includes a compressor 4, a combustor 6 for combusting compressed air generated by the compressor 4 in mixture with fuel, a turbine 8 for obtaining power from a combustion gas generated by the compressor 4, and a gas turbine exhaust casing 12 configured to allow passage of an exhaust gas of the turbine 8 (the combustion gas having finished work in the turbine 8).

Figure 2:
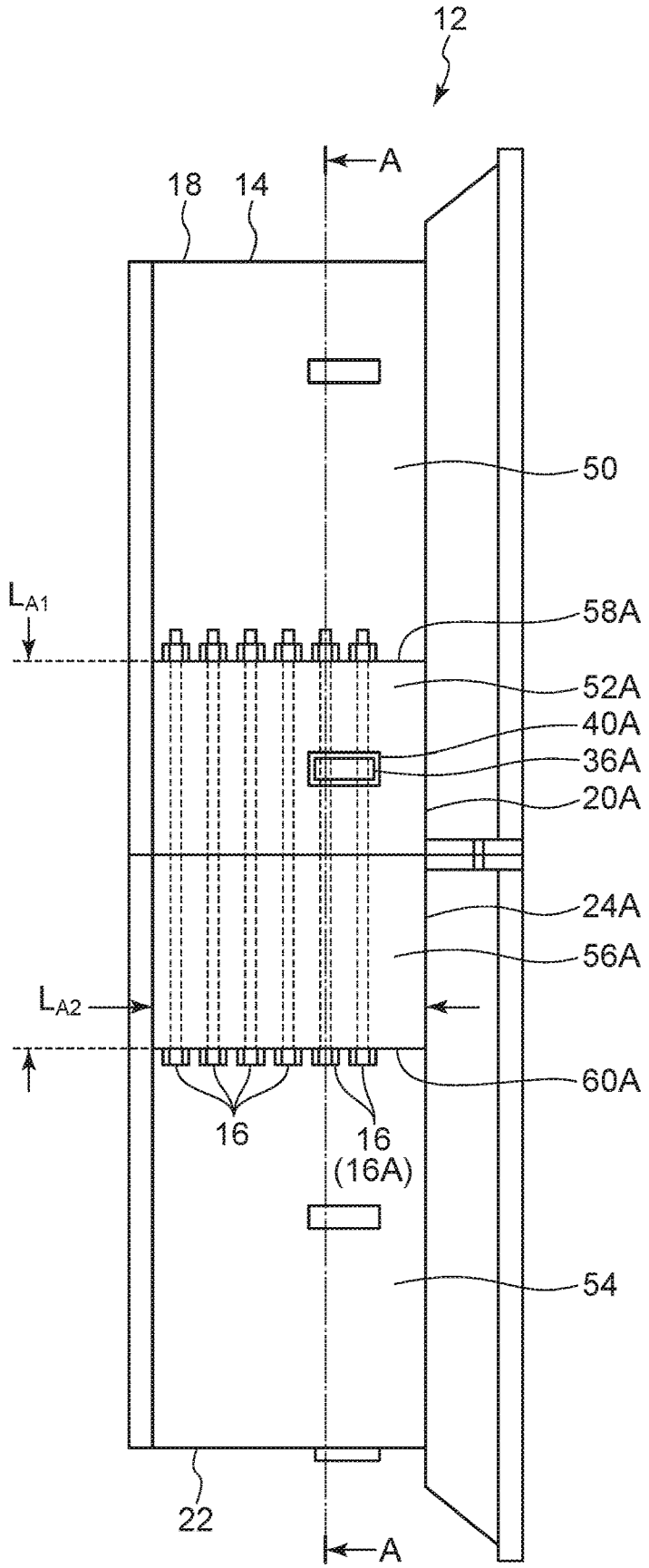
FIG. 2 is a side view showing the schematic configuration of a gas turbine exhaust casing 12 according to an embodiment.
Figure 3:
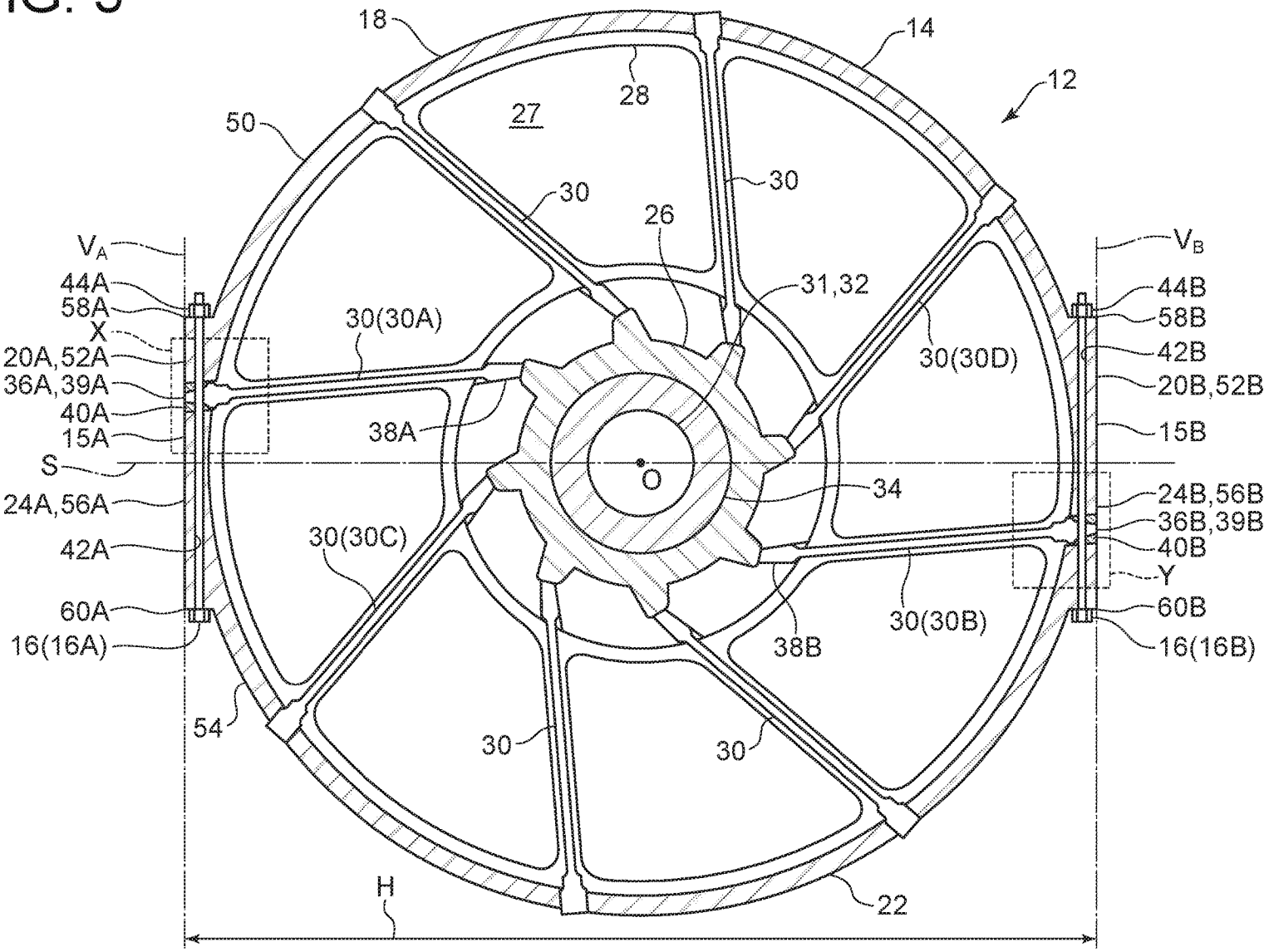
FIG. 3 is a cross-sectional view taken along line A-A in FIG. 2.

FIG. 2 is a side view showing the schematic configuration of the gas turbine exhaust casing 12 according to an embodiment. FIG. 3 is a cross-sectional view taken along line A-A in FIG. 2.

As shown in FIGS. 2 and 3, the gas turbine exhaust casing 12 includes a tubular casing wall 14 and a plurality of fastening bolts 16 disposed on the casing wall 14. The casing wall 14 includes an upper half casing 18 forming the upper half of the casing wall 14 and a lower half casing 22 forming the lower half of the casing wall 14. The plurality of fastening bolts 16 include the plurality of fastening bolts 16 fastening a flange portion 20A and a flange portion 24A, and the plurality of fastening bolts 16 fastening a flange portion 20B and a flange portion 24B. The flange portion 20A is disposed at one end of the upper half casing 18, and the flange portion 24A is disposed at one end of the lower half casing 22. The flange portion 20B is disposed at the other end of the upper half casing 18, and the flange portion 24B is disposed at the other end of the lower half casing 22.

As shown in FIG. 3, the gas turbine exhaust casing 12 includes a bearing box 26 housed in the casing wall 14, a diffuser portion 28 forming an annular exhaust gas flow passage 27 between the casing wall 14 and the bearing box 26, and a plurality of struts 30 disposed at intervals in the circumferential direction of the casing wall 14 and coupling the casing wall 14 and the bearing box 26. In the illustrated exemplary embodiment, the number of struts 30 is eight, and each of the struts 30 extends in a direction oblique to the radial direction. The bearing box 26 internally includes a bearing portion 34 rotatably supporting a rotating shaft 32 of a turbine rotor 31. The axial center of the casing wall 14, the axial center of the bearing box 26, and the axial center of the bearing portion 34 match an axial center O of the rotating shaft 32 of the turbine rotor 31.

The plurality of struts 30 include a strut 30A (penetrated strut) which has an end 36A penetrated by at least one fastening bolt 16A of the plurality of fastening bolts 16. The end 36A is an end of the strut 30A on the side of the casing wall 14 (the outer circumferential side of the gas turbine exhaust casing 12) and is connected to the upper half casing 18 in the illustrated embodiment. An end 38A of the strut 30A on a side opposite to the casing wall 14 is connected to the bearing box 26. In the exemplary embodiment shown in FIG. 2, the flange portion 20A and the flange portion 24A are fastened with the plurality of fastening bolts 16 arrayed in the axial direction, and the two fastening bolts 16A of the plurality of fastening bolts 16 penetrate the end 36A.

As shown in FIG. 3, the plurality of struts 30 include a strut 30B (penetrated strut) which has an end 36B penetrated by at least one fastening bolt 16B of the plurality of fastening bolts 16 on a side opposite to the strut 30A across the rotating shaft 32. The end 36B is an end of the strut 30B on the side of the casing wall 14 and is connected to the lower half casing 22 in the illustrated embodiment. An end 38B of the strut 30B on the side opposite to the casing wall 14 is connected to the bearing box 26.

The struts 30A, 30B are the two struts 30 of the plurality of struts 30 having the ends 36A, 36B on the side of the casing wall 14 closest to a horizontal plane S which is a boundary between the upper half casing 18 and the lower half casing 22. The fastening bolts 16 do not penetrate the struts 30 of the plurality of struts 30 other than the struts 30A, 30B.

Figure 4:
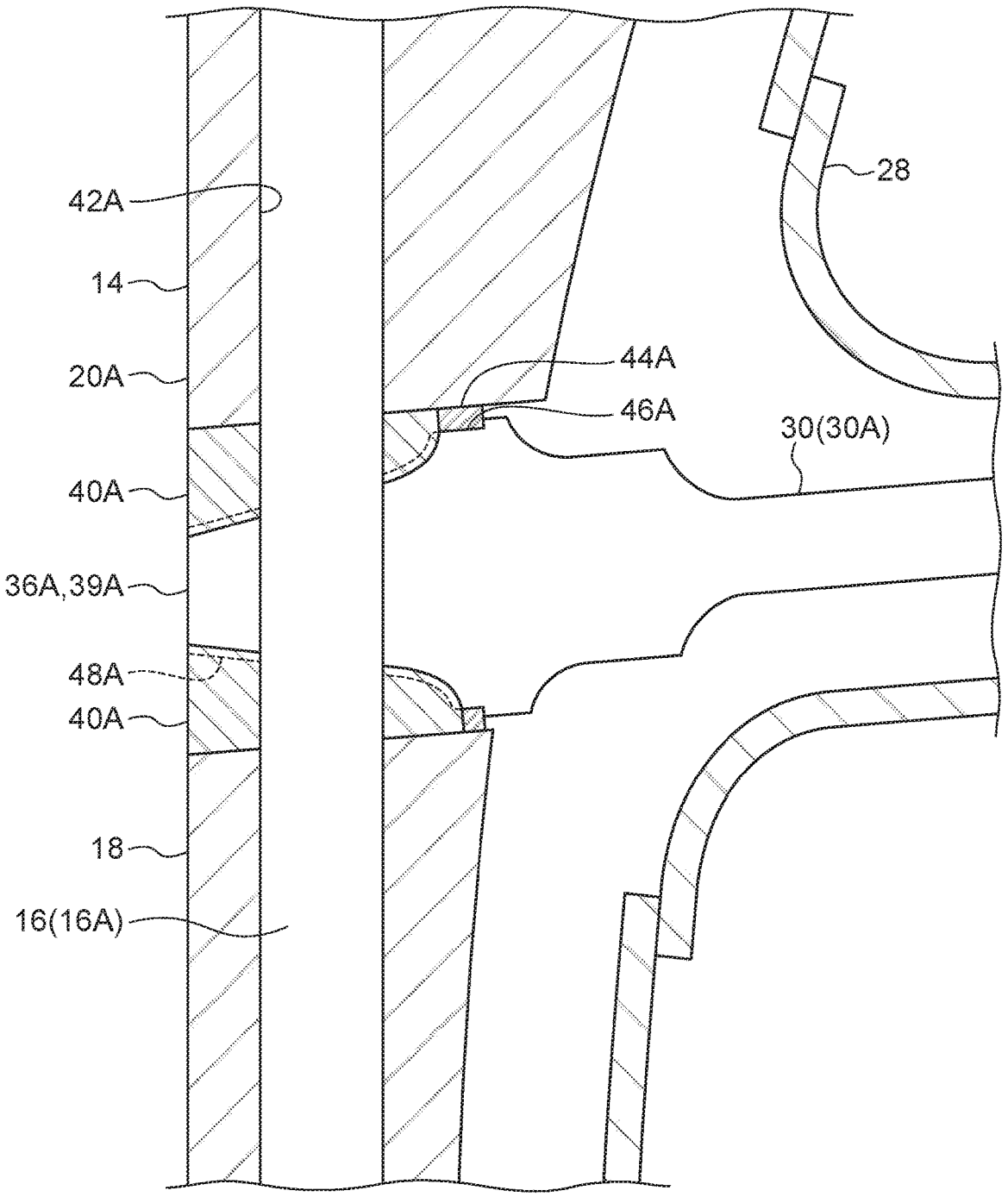
FIG. 4 is an enlarged schematic view of a connection portion between a casing wall 14 and a strut 30A (X portion of FIG. 3).
Figure 5:
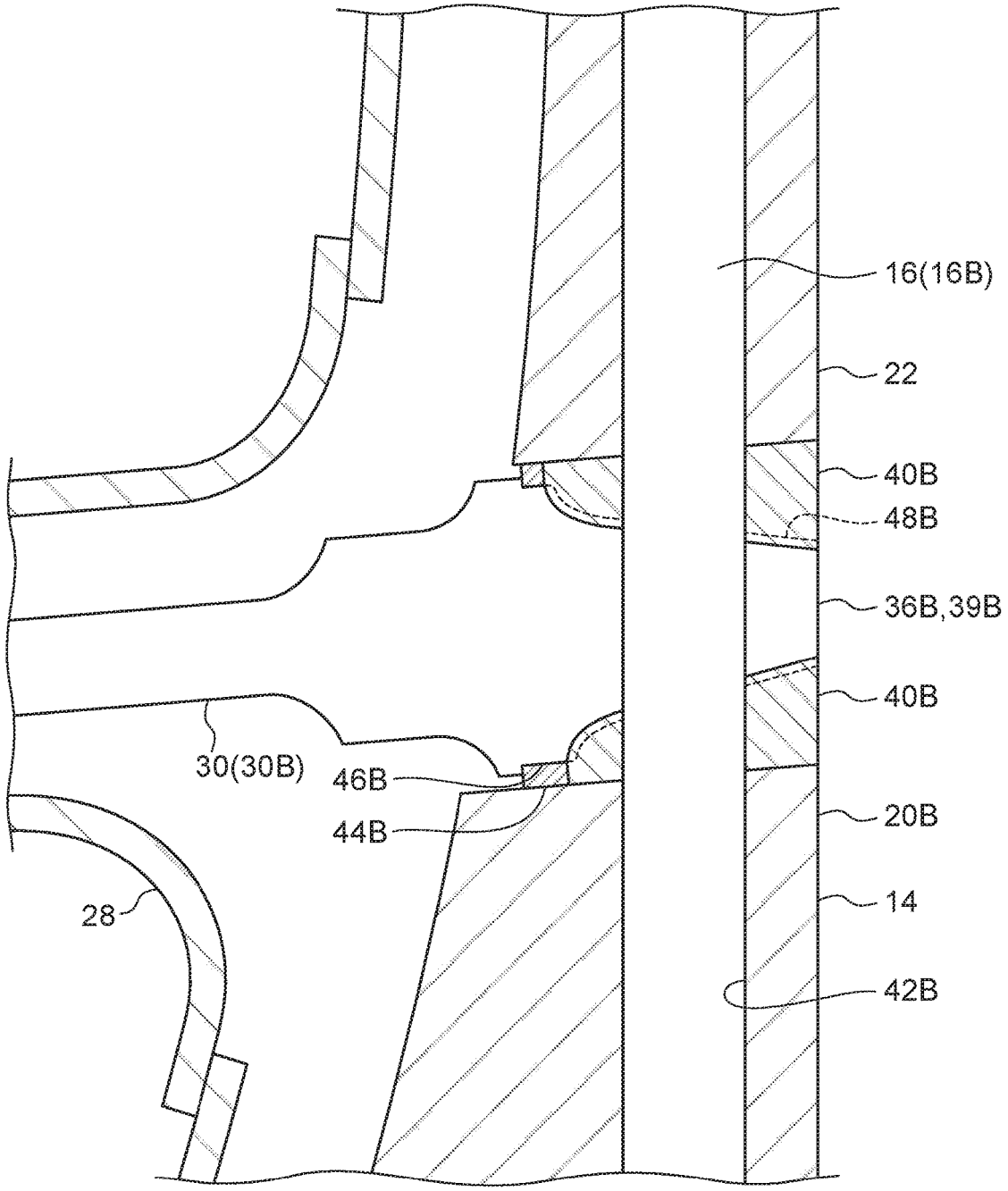
FIG. 5 is an enlarged schematic view of a connection portion between the casing wall 14 and a strut 30B (Y portion of FIG. 3).

Next, the detailed configurations of connection portions between the casing wall 14 and the struts 30A, 30B will be described with reference to FIGS. 4 and 5. FIG. 4 is an enlarged schematic view of the connection portion between the casing wall 14 and the strut 30A (X portion of FIG. 3). FIG. 5 is an enlarged schematic view of the connection portion between the casing wall 14 and the strut 30B (Y portion of FIG. 3).

As shown in FIG. 4, the end 36A of the strut 30A and the upper half casing 18 are connected via a welding portion 40A. Furthermore, as shown in at least one of FIGS. 3 and 4, a through hole 42A is formed, which penetrates the flange portion 20A of the upper half casing 18, the welding portion 40A, the end 36A, and the flange portion 24A of the lower half casing 22 in the vertical direction. The fastening bolt 16A is inserted through the through hole 42A, penetrates the flange portion 24A, the welding portion 40A, the end 36A, and the flange portion 20A, and is screwed to a nut 44A to fasten the upper half casing 18 and the lower half casing 22. Moreover, an end surface 39A of the strut 30A on the side of the casing wall 14 (the outer circumferential side of the gas turbine exhaust casing 12) is formed so as not to protrude from an outer surface 15A of the casing wall 14.

The end 36A shown in FIG. 4 includes a holding portion 46A holding a doubling plate 43A between itself and the upper half casing 18. The upper half casing 18 and a groove 48A of a tapered shape, which is formed between the holding portion 46A and a tip at the time of manufacture, are welded such that the groove 48A is embedded in the upper half casing 18, thereby achieving a high strength.

Figure 6:
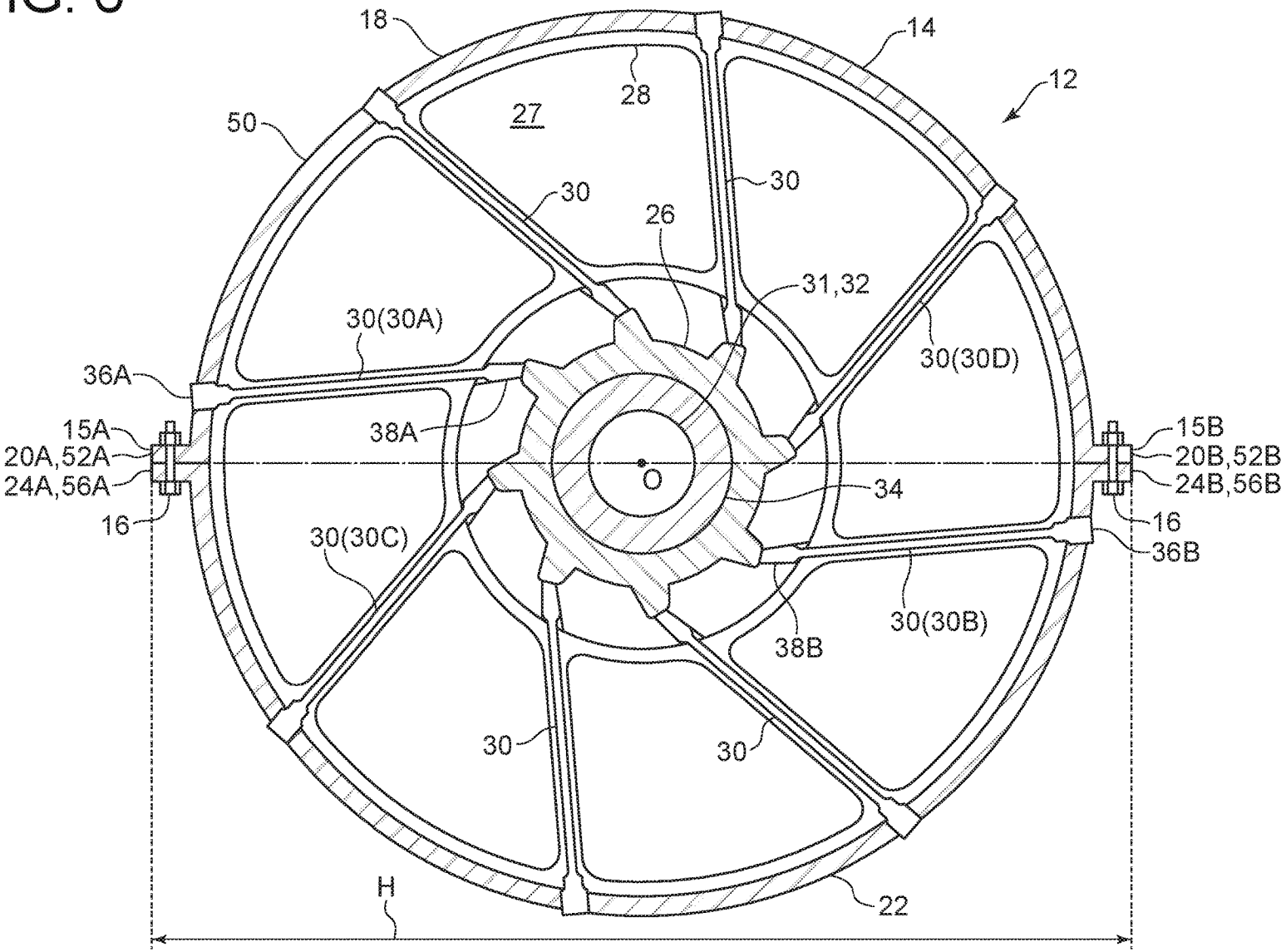
FIG. 6 is view showing the schematic configuration of a case in which an upper half casing 18 and a lower half casing 22 are fastened with a fastening bolt 16 while avoiding an end 36A of the strut 30A.

With the above configuration, since the fastening bolt 16A penetrates the end 36A of the strut 30A, and fastens the upper half casing 18 and the lower half casing 22, it is possible to reduce a distance between the fastening bolt 16 and the axial center O of the turbine rotor 31 as compared with a case in which the upper half casing 18 and the lower half casing 22 are fastened with the fastening bolt 16 while avoiding the end 36A of the strut 30A (a case in which the flange portions 20A, 24A protruding greatly in the radial direction are fastened with the fastening bolts 16 as shown in FIG. 6). Thus, as compared with the case shown in FIG. 6, it is possible to reduce a distance between the axial center O of the turbine rotor 31 and the outer surface 15A (the end surface 52A of the flange portion 20A and the end surface 56A of the flange portion 24A) of the casing wall 14 formed along the fastening bolt 16. Therefore, it is possible to suppress upsizing of an external dimension H of the external dimension of the gas turbine exhaust casing 12 in the horizontal direction orthogonal to the axial center O of the turbine rotor 31 (see FIG. 3) while upsizing the exhaust gas flow passage 27.

Moreover, it is possible to reduce a tension load acting on the fastening bolt 16A as compared with the case in which the upper half casing 18 and the lower half casing 22 are fastened with the fastening bolt 16A while avoiding the end 36A of the strut 30A (see FIG. 6) when the tubular casing wall 14 expands due to heat transmission from a high-temperature exhaust gas. Therefore, it is possible to suppress a breakage in the fastening bolt 16A and to implement a stable operation of the gas turbine 2.

As shown in FIG. 5, the end 36B of the strut 30B and the lower half casing 22 are connected via a welding portion 40B. Furthermore, as shown in at least one of FIGS. 3 and 4, a through hole 42B is formed, which penetrates the flange portion 20B of the upper half casing 18, the welding portion 40B, the end 36B, and the flange portion 24B of the lower half casing 22 in the vertical direction. The fastening bolt 16B is inserted through the through hole 42B, penetrates the flange portion 24B, the welding portion 40B, the end 36B, and the flange portion 20B, and is screwed to a nut 44B to fasten the upper half casing 18 and the lower half casing 22. Moreover, an end surface 39B of the strut 30B on the side of the casing wall 14 (the outer circumferential side of the gas turbine exhaust casing 12) is formed so as not to protrude from an outer surface 15B of the casing wall 14.

The end 36B shown in FIG. 5 includes a holding portion 46B holding a doubling plate 43B between itself and the lower half casing 22. The lower half casing 22 and a groove 48B of a tapered shape, which is formed between the holding portion 46B and a tip at the time of manufacture, are welded such that the groove 48B is embedded in the lower half casing 22, thereby achieving a high strength.

With the above configuration, since the fastening bolt 16B penetrates the end 36B of the strut 30B, and fastens the upper half casing 18 and the lower half casing 22, it is possible to reduce a distance between the fastening bolt 16B and the axial center O of the turbine rotor 31 as compared with a case in which the upper half casing 18 and the lower half casing 22 are fastened with the fastening bolt 16 while avoiding the end 36B of the strut 30B (see FIG. 6). Thus, as compared with the case shown in FIG. 6, it is possible to reduce a distance between the axial center O of the turbine rotor 31 and the outer surface 15B (the end surface 52B of the flange portion 20B and the end surface 56B of the flange portion 24B) of the casing wall 14 formed along the fastening bolt 16. Therefore, it is possible to suppress upsizing of the external dimension H of the external dimension of the gas turbine exhaust casing 12 (see FIG. 3) while upsizing the exhaust gas flow passage 27.

Moreover, it is possible to reduce a tension load acting on the fastening bolt 16B as compared with the case in which the upper half casing 18 and the lower half casing 22 are fastened with the fastening bolt 16B while avoiding the end 36B of the strut 30B (see FIG. 6) when the tubular casing wall 14 expands due to heat transmission from the high-temperature exhaust gas. Therefore, it is possible to suppress a breakage in the fastening bolt 16B and to implement the stable operation of the gas turbine 2.

As shown in at least one of FIGS. 2 and 3, an outer surface 50 of the upper half casing 18 includes a first planar portion 52A formed along a vertical plane VA orthogonal to the radial direction at one end in the horizontal direction orthogonal to the axial direction. An outer surface 54 of the lower half casing 22 includes a second planar portion 56A which is adjacent to the first planar portion 52A and is formed along the vertical plane VA at the one end in the horizontal direction orthogonal to the axial direction. In the illustrated embodiment, the first planar portion 52A is an end surface of the flange portion 20A, and the second planar portion 56A is an end surface of the flange portion 24A. As shown in FIG. 2, the first planar portion 52A and the second planar portion 56A are configured to satisfy $L_{A1}>L_{A2}$, where $L_{A1}$ is a vertical dimension from an upper end 58A of the first planar portion 52A to a lower end 60A of the second planar portion 56A, and $L_{A2}$ is an axial dimension of the first planar portion 52A.

As the distance between the fastening bolt 16A and the axial center O of the turbine rotor 31 decreases, a bolt length required of the fastening bolt 16A in order to fasten the upper half casing 18 and the lower half casing 22 increases. In this regard, with the above configuration, since $L_{A1}>L_{A2}$ is satisfied, it is possible to form the first planar portion 52A and the second planar portion 56A along the significantly long fastening bolt 16A which can reduce the distance with the axial center O of the turbine rotor 31 while penetrating the end 36A of the strut 30A. Therefore, it is possible to suppress the expansion of the external dimension H of the gas turbine exhaust casing 12 while upsizing the exhaust gas flow passage 27.

As shown in FIG. 3, the outer surface 50 of the upper half casing 18 includes a first planar portion 52B formed along a vertical plane $V_B$ orthogonal to the radial direction at the other end in the horizontal direction orthogonal to the axial direction. The outer surface 54 of the lower half casing 22 includes a second planar portion 56B which is adjacent to the first planar portion 52B and is formed along the vertical plane $V_B$ at the other end in the horizontal direction orthogonal to the axial direction. In the illustrated embodiment, the first planar portion 52B is an end surface of the flange portion 20B, and the second planar portion 56B is an end surface of the flange portion 24B. The first planar portion 52B and the second planar portion 56B are configured to satisfy $L_{B1}>L_{B2}$, where $L_{B1}$ is a vertical dimension from an upper end 58B of the first planar portion 52B to a lower end 60B of the second planar portion 56B, and $L_{B2}$ is an axial dimension of the first planar portion 52B.

As the distance between the fastening bolt 16B and the axial center O of the turbine rotor 31 decreases, a bolt length required of the fastening bolt 16B in order to fasten the upper half casing 18 and the lower half casing 22 increases. In this regard, with the above configuration, since $L_{B1}>L_{B2}$ is satisfied, it is possible to form the first planar portion 52B and the second planar portion 56B along the significantly long fastening bolt 16B which can reduce the distance with the axial center O of the turbine rotor 31 while penetrating the end 36B of the strut 30B. Therefore, it is possible to suppress the expansion of the external dimension H of the gas turbine exhaust casing 12 while upsizing the exhaust gas flow passage 27.

Figure 7:
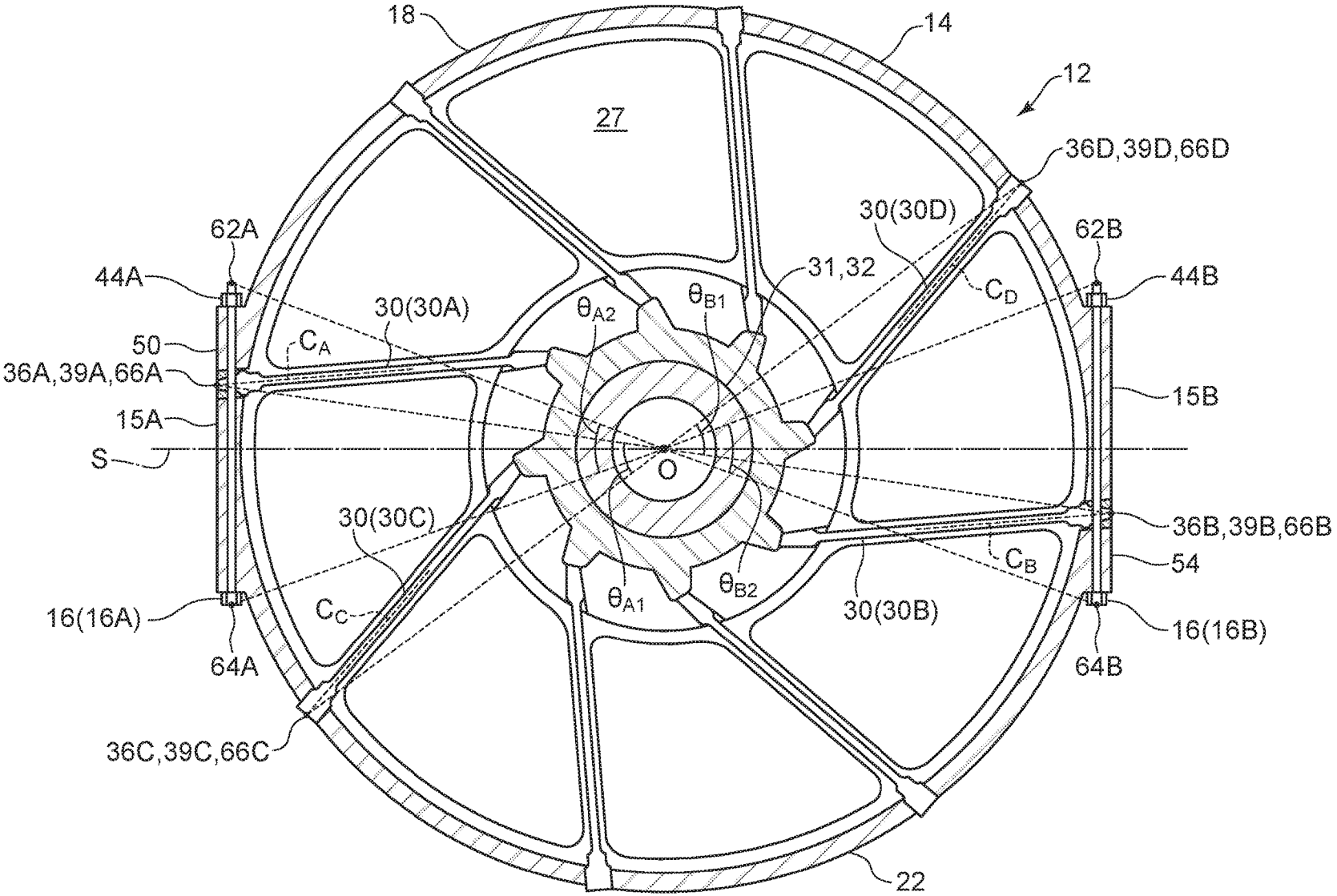
FIG. 7 is a cross-sectional view taken along line A-A in FIG. 2.

As shown in FIG. 7, the plurality of struts 30 include a strut 30C (adjacent strut) adjacent to the strut 30A across the boundary S between the upper half casing 18 and the lower half casing 22. $\theta_{A2}>0.5\theta_{A1}$ is satisfied, where, regarding angles around the axial center O of the turbine rotor 31, $\theta_{A1}$ is an angle between the end 36A of the strut 30A and an end 36C of the strut 30C, and $\theta_{A2}$ is an angle between an upper end 62A of the fastening bolt 16A and a lower end 64A of the fastening bolt 16A. In the illustrated embodiment, the angle $\theta_{A1}$ between the end 36A of the strut 30A and the end 36C of the strut 30C is an angle between an intersection point 66A and an intersection point 66C. The intersection point 66A is between an axis $C_A$ of the strut 30A and an end surface 39A of the strut 30A on the side of the casing wall 14. The intersection point 66C is between an axis Cc of the strut 30C and an end surface 39C of the strut 30C on the side of the casing wall 14 (the outer circumferential side of the gas turbine exhaust casing 12).

Thus, the fastening bolt 16A has a significantly long length with respect to a circumferential distance between the respective ends 36A and 36C of the adjacent struts 30A and 30C. Thus, it is possible to fasten the upper half casing 18 and the lower half casing 22 by using the significantly long fastening bolt 16A which can reduce the distance with the axial center O of the turbine rotor 31 while penetrating the end 36A of the strut 30A. Therefore, it is possible to suppress the expansion of the external dimension H of the gas turbine exhaust casing 12 (see FIG. 3) while upsizing the exhaust gas flow passage 27.

As shown in FIG. 7, the plurality of struts 30 include a strut 30D (adjacent strut) adjacent to the strut 30B across the boundary S between the upper half casing 18 and the lower half casing 22. $\theta_{B2}>0.5\theta_{B1}$ is satisfied, where, regarding angles around the axial center O of the turbine rotor 31, $\theta_{B1}$ is an angle between the end 36B of the strut 30B and an end 36D of the strut 30D, and $\theta_{B2}$ is an angle between an upper end 62B of the fastening bolt 16B and a lower end 64B of the fastening bolt 16B. In the illustrated embodiment, the angle $\theta_{B1}$ between the end 36B of the strut 30B and the end 36D of the strut 30D is an angle between an intersection point 66B and an intersection point 66D. The intersection point 66B is between an axis CB of the strut 30B and the end surface 39B of the strut 30B on the side of the casing wall 14. The intersection point 66D is between an axis $C_D$ of the strut 30D and an end surface 39D of the strut 30D on the side of the casing wall 14 (the outer circumferential side of the gas turbine exhaust casing 12).

Thus, the fastening bolt 16B has a significantly long length with respect to a circumferential distance between the respective ends 36B and 36D of the adjacent struts 30B and 30D. Thus, it is possible to fasten the upper half casing 18 and the lower half casing 22 by using the significantly long fastening bolt 16B which can reduce the distance with the axial center O of the turbine rotor 31 while penetrating the end 36B of the strut 30B. Therefore, it is possible to suppress the expansion of the external dimension H of the gas turbine exhaust casing 12 (see FIG. 3) while upsizing the exhaust gas flow passage 27.

The present invention is not limited to the above-described embodiment, and also includes an embodiment obtained by modifying the above-described embodiment and an embodiment obtained by combining these embodiments as appropriate.

The invention claimed is:

1. A gas turbine exhaust casing, comprising:

a tubular casing wall;

a bearing box housed in the casing wall;

a plurality of struts disposed at intervals in a circumferential direction of the casing wall, and coupling the casing wall and the bearing box; and a plurality of fastening bolts disposed on the casing wall, wherein the casing wall includes an upper half casing forming an upper half of the casing wall and a lower half casing forming a lower half of the casing wall, wherein the plurality of fastening bolts fasten the upper half casing and the lower half casing, and wherein the plurality of struts include a penetrated strut which has an end penetrated by at least one fastening bolt of the plurality of fastening bolts.

2. The gas turbine exhaust casing according to claim 1, wherein the end of the penetrated strut and the casing wall are connected via a welding portion, and wherein the at least one fastening bolt penetrates the end and the welding portion.

3. The gas turbine exhaust casing according to claim 1, wherein the penetrated strut has an end surface on a side of the casing wall, the end surface being formed so as not to protrude from an outer surface of the casing wall.

4. The gas turbine exhaust casing according to claim 1, wherein the plurality of struts include an adjacent strut adjacent to the penetrated strut across a boundary between the upper half casing and the lower half casing, and wherein $\theta_2 > 0.5\theta_1$ is satisfied, where, regarding angles around an axial center of the casing wall, $\theta_1$ is an angle between the end of the penetrated strut and an end of the adjacent strut, and $\theta_2$ is an angle between an upper end of the at least one fastening bolt penetrating the penetrated strut and a lower end of the at least one fastening bolt.

5. The gas turbine exhaust casing according to claim 1, wherein an outer surface of the upper half casing includes a first planar portion formed along a vertical plane, wherein an outer surface of the lower half casing includes a second planar portion which is adjacent to the first planar portion and is formed along the vertical plane, and wherein $L_1 > L_2$ is satisfied, where $L_1$ is a vertical dimension from an upper end of the first planar portion to a lower end of the second planar portion, and $L_2$ is an axial dimension of the first planar portion.

6. A gas turbine, comprising:

a compressor;

a combustor for combusting compressed air generated by the compressor in mixture with fuel;

a turbine for obtaining power from a combustion gas generated by the combustor; and the gas turbine exhaust casing according to claim 1, the gas turbine exhaust casing being configured to allow passage of an exhaust gas of the turbine.

* * * * *